United States Patent [19]

Kellogg

[11] 4,270,719

[45] Jun. 2, 1981

[54] SHELF BRACKET

[76] Inventor: Harlan F. Kellogg, 1617 Sprucewood, Rockford, Ill. 61107

[21] Appl. No.: 62,700

[22] Filed: Aug. 1, 1979

[51] Int. Cl.[3] ..... A47G 29/02

[52] U.S. Cl. ..... 248/235

[58] Field of Search ..... 248/222.4, 223.1, 224.3, 248/224.4, 235, 243, 247, 248, 250, 314

[56] References Cited

U.S. PATENT DOCUMENTS

| | | | |
|---|---|---|---|
| 541,114 | 6/1895 | Nolan | 248/222.4 X |
| 716,713 | 12/1902 | Hughes | 248/224.3 X |
| 3,388,884 | 6/1968 | Eggler et al. | 248/224.3 X |
| 4,013,253 | 3/1977 | Perrault | 248/243 X |
| 4,121,801 | 10/1978 | Kellogg | 248/235 |

FOREIGN PATENT DOCUMENTS

| | | | |
|---|---|---|---|
| 1280059 | 7/1972 | United Kingdom | 248/235 |

*Primary Examiner*—William H. Schultz

*Attorney, Agent, or Firm*—Vernon J. Pillote

[57] ABSTRACT

A shelf bracket including a shelf bracket member formed of non-metallic material and having an upper shelf supporting surface and a rear abutment surface and a generally L-shaped metal shelf attaching bracket for mounting the shelf bracket member on a supporting surface. The L-shaped shelf attaching bracket has a generally horizontal upper leg and a depending tongue at its forward end extending downwardly into a notch in the shelf bracket member and a generally vertical rear leg with a tongue at its lower end extending forwardly into a notch in the rear portion of the shelf bracket member. Protrusions are formed on the tongues to engage one wall of the notch and press the tongues into firm engagement with the other wall of the notch to inhibit bending of the tongues relative to the respective leg and to also hold the shelf attaching bracket in assembled relation on the shelf bracket member.

2 Claims, 5 Drawing Figures

Fig. 1.
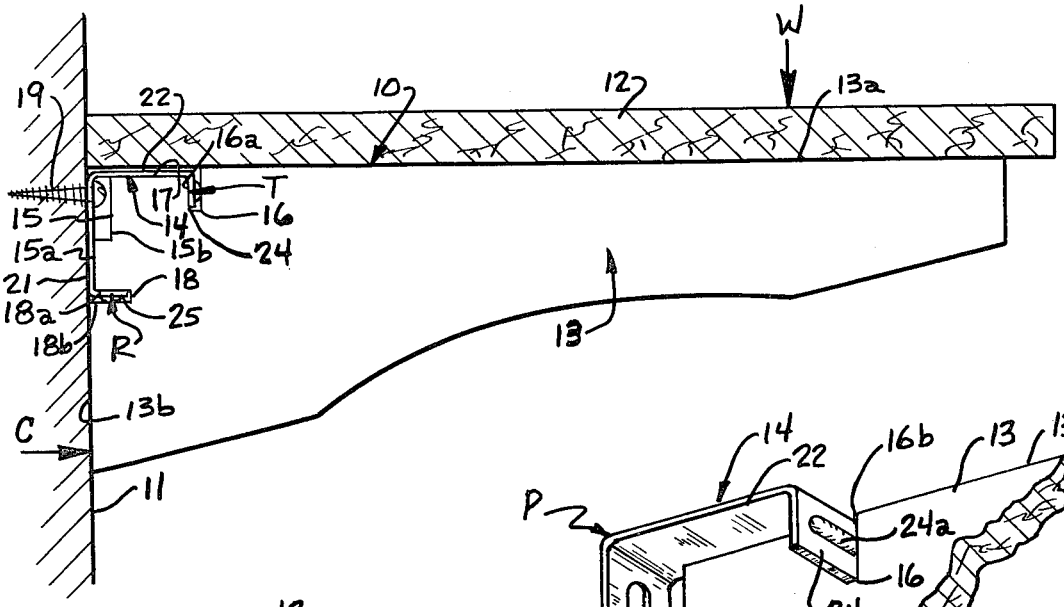
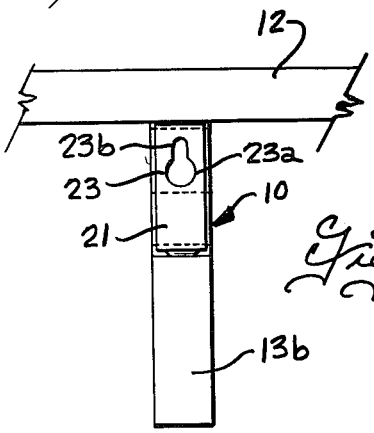
Fig. 2.
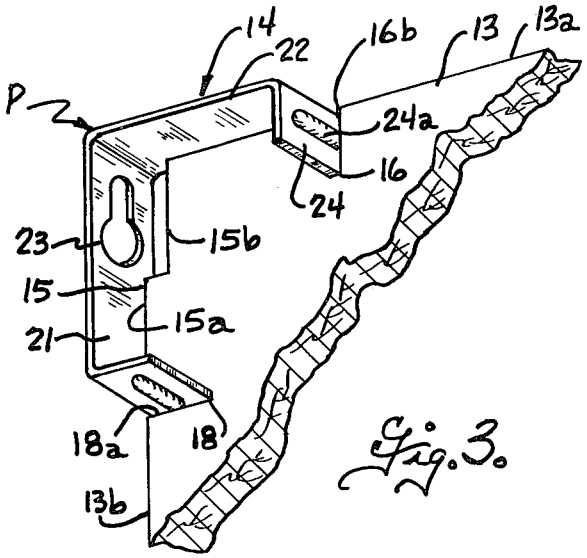
Fig. 3.
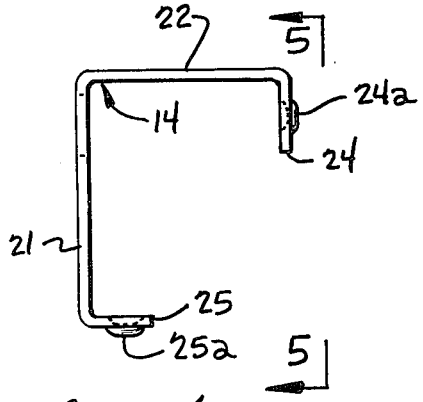
Fig. 4.
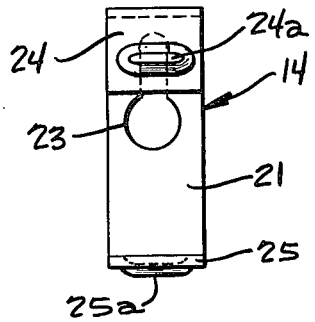
Fig. 5.

SHELF BRACKET

BACKGROUND OF THE INVENTION

The present invention relates to improvements in the shelf bracket disclosed in my prior U.S. Pat. No. 4,121,801, issued Oct. 24, 1978. In my prior patent, the shelf bracket included a shelf bracket member of non-metallic material such as particle board having a top shelf supporting surface and a rear abutment surface extending perpendicular to the shelf supporting surface adjacent the lower rear portion of the shelf bracket member, and a rear recessed surface above and offset forwardly from the rear abutment surface. In one embodiment disclosed in my prior patent, the shelf bracket had a first notch extending downwardly from the top shelf supporting surface and spaced forwardly from the rear recessed surface, and a second notch extending forwardly from the rear abutment surface. The shelf bracket member was attached to a supporting surface by a metal shelf attaching bracket having a generally L-shaped configuration and which included a rear leg having an upper mounting plate portion spaced rearwardly from the rear recessed surface with a keyhole shaped opening therein for receiving a headed mounting fastener, and an upper leg extending forwardly from the upper end of the rear leg and having a depending tongue at its forward end extending downwardly into a first notch and the top of the shelf bracket member to take up the horizontal forces, and a second tongue extending forwardly from the lower end of the rear leg into the second notch of the shelf bracket member to take up the vertical loading on the shelf bracket member.

While my prior shelf bracket worked satisfactorily, it was found that, under very heavy loading on the shelf bracket member, the tongues on the shelf attaching bracket tended to flex or bend relative to the respective leg such that they did not uniformly contact the load bearing wall of the respective notch in the bracket member. This caused a stress concentration adjacent the outer portions of the load bearing wall of the notches, which stress concentration was particularly undesirable when the shelf bracket member is formed of a relatively soft material such as particle board or even wood.

SUMMARY OF THE INVENTION

It is the object of the present invention to overcome the problems encountered in my prior shelf bracket by providing a shelf bracket member and shelf attaching bracket construction so arranged as to inhibit flexing of the tongues on the shelf attaching bracket relative to the respective leg when the shelf bracket member is under load.

Accordingly, the present invention provides a shelf bracket including an elongated shelf bracket member having a top shelf supporting surface and a rear abutment surface extending perpendicular to the shelf supporting surface adjacent the lower rear corner of the shelf bracket member, shelf bracket member having a rear recessed surface above and offset forwardly from the rear abutment surface, the shelf bracket member having a first notch extending downwardly from the top shelf supporting surface and spaced forwardly from the rear recessed surface and defining inner and outer opposed notch walls extending between the side faces of the shelf bracket member, the shelf bracket member having a second notch extending forwardly from the rear abutment surface and spaced below the top shelf supporting surface and defining upper and lower opposed notch walls extending between the side faces of the shelf bracket member, and a shelf attaching bracket including a rear leg and an upper leg arranged in a generally L-shaped configuration, the rear leg having an upper mounting plate portion spaced rearwardly from the rear recessed surface and a keyhole shaped opening in the upper mounting plate portion for receiving a headed mounting fastener, the upper leg extending forwardly from the upper end of the rear leg in overlying relation to the bracket member and having a first depending tongue at its forward end adapted to extend into the first notch, a second forwardly extending tongue on the lower end of the rear leg adapted to extend into the second notch, the first and second tongues being generally flat and having a thickness less than the spacing between the opposed notch walls of the respective first and second notches, characterized in that the first tongue has a protrusion on the side engageable with the outer notch wall of the first notch to press the first tongue against the inner notch wall of the first notch and the second tongue has a protrusion on the side engageable with the lower notch wall to press the second tongue against the upper notch wall of the second notch whereby to inhibit bending of the first and second tongues relative to the respective upper and rear legs of the shelf bracket attaching member and to inhibit movement of the shelf bracket member laterally of the shelf attaching bracket after assembly thereof.

These, together with other objects, features and advantages of the present invention will be more readily understood by reference to the following detailed description, when taken in connection with the accompanying drawings wherein:

FIG. 1 is a vertical sectional view through a shelf assembly embodying the present invention;

FIG. 2 is a rear elevational view of the shelf bracket shown in FIG. 1;

FIG. 3 is a fragmentary perspective view illustrating assembly of the shelf attaching bracket on the shelf bracket member;

FIG. 4 is a side elevational view of the shelf attaching bracket, and

FIG. 5 is a front elevational view of the shelf attaching bracket taken on the plane 5—5 of FIG. 4.

The shelf bracket assembly designated generally by the numeral 10 is adapted for attachment to an upright surface such as a wall 11 to extend therefrom in cantilever fashion for supporting a shelf 12. The shelf assembly includes a shelf bracket member 13 conveniently formed of a non-metallic material such as wood particle board or wood, and a shelf attaching bracket 14 connected to the shelf bracket member 13 adjacent the rear end thereof. The shelf bracket member 13 has a top shelf supporting surface 13*a* which extends generally horizontally, and a rear abutment surface 13*b* extends perpendicular to the top shelf supporting surface and is located adjacent the lower rear portion of the shelf bracket member. The shelf bracket member 13 also has a rear recessed surface 15 located above and offset forwardly from the rear abutment surface 13*b*. The shelf bracket member 13 also has a first notch 16 extending downwardly from the top shelf supporting surface 13*a* adjacent the rear end thereof and spaced forwardly from the rear recessed surface 15, and a top recessed surface 17 that extends rearwardly from the notch 16 and is offset below the top shelf supporting surface to receive an upper leg of the shelf attaching bracket. A second notch 18 is formed in the rear end of the shelf bracket member and extends forwardly from the rear abutment surface at a location spaced below the top shelf supporting surface. The first notch 16 defines rear and forward opposed notch walls 16*a* and 16*b* that extend between the side faces of the bracket member and the second notch 18 define upper and lower notch walls 18*a* and 18*b* that extend between the side faces of the shelf bracket. In the preferred embodiment illustrated, the rear recessed surface 15 is stepped and include a lower rear recessed surface portion 15*a* that is offset forwardly from the abutment surface 13*b* a distance to receive the rear leg of the shelf attaching bracket 14 and an upper rear recessed surface portion 15*b* that is offset forwardly from the lower rear recessed surface portion to provide a clearance spaced to receive the head of a mounting fastener 19. The shelf attaching bracket 14 is preferably formed of metal and may be formed by bending a flat metal strap. The shelf attaching bracket has a rear leg 21 and an upper leg 22 extending forwardly from the upper end of the rear leg. The rear leg 21 has a keyhole shaped opening 23 therein (FIG. 2) for receiving a fastener such as the mounting screw 19 for attaching the bracket assembly to the upright supporting surface or wall 11. The upper leg 22 of the shelf attaching bracket extends forwardly in overlying relation with the upper recessed surface 17 on the bracket member and has a depending tongue 24 at its forward end that extends downwardly into the notch 16. The rear leg of the shelf attaching bracket extends across the upper rear recessed surface 15*b* and overlies the lower recessed surface 15*a*, and has a tongue 25 at its lower end that extends forwardly into the notch 18. As best shown in FIG. 2, the keyhole shaped opening 23 has an eye portion 23*a* and a slot portion 23*b* that extends upwardly from the eye portion.

The tongues 24 and 25 are generally flat and have a thickness less than the spacing between the opposed notch walls of the respective first and second notches, in order to facilitate assembly of the shelf attaching bracket on the shelf bracket member. When a load such as indicated by the arrowed W in FIG. 1 is applied to the shelf assembly at a location spaced from the wall, the shelf bracket member 13 is forced downwardly and is also subjected to a turning moment which tends to press the rear abutment surface 13*b* against the wall and to pull the upper rear portion of the shelf bracket member away from the wall. This turning moment on the shelf bracket assembly is opposed by a horizontal force couple including a generally horizontal force component indicated by the arrow C applied to the rear abutment surface 13*b* on the bracket member, and an opposing generally horizontal force component indicated by the arrow T applied by the tongue 24 of the shelf attaching bracket to the rear notch wall 16*a* of the notch 16. The downward load W is opposed by a vertical reaction force component indicated by the arrow R applied by the tongue 25 to the upper notch wall 18*a* of the notch 18. The first and second tongues 24 and 25 are generally flat and have a thickness less than the spacing between the opposed notch walls of the respective first and second notches 16 and 18. When the load W is applied to the shelf assembly, the forces exerted on the depending tongue 24 tend to cause the tongue to bend or flex so that the lower portion of the tongue 24 tends to move away from the rear notch wall 16*a*. In order to inhibit flexing or bending of the tongue 24 relative to its upper leg 22, a protrusion 24*a* is formed on the side of the tongue 24 that engages the forward notch wall 16*b* of the notch 16 at a location below the upper leg 22, to press the tongue 24 against the rear notch wall 16*a*. This inhibits flexing or bending of the tongue 24 relative to the upper leg 22 and distributes the load or forces between the tongue 24 and the shelf bracket member 13, more uniformly across the rear notch wall 16*a*. In a like manner, the load W applied to the shelf assembly tends to cause the tongue 25 to bend downwardly so that the forward portion tends to move away from the upper notch wall 18*a* of the notch 18. In order to inhibit this bending or flexing of the tongue 25, a protrusion 25*a* is formed on the side of the tongue 25 that engages the lower notch wall 18*b* of the notch 18 at a location forwardly of the rear leg 21 to thereby press the tongue 25 against the upper notch wall portion 18*a*. In this manner, the vertical forces between the shelf bracket member and the shelf attaching bracket are distributed more uniformly across the upper notch wall 18*a* of the notch 18.

The shelf attaching bracket can be readily assembled onto the shelf bracket member from one side of the latter. As previously described, the tongues 24 and 25 have a thickness less than the spacing between the opposed notch walls of the respective notch and the shelf attaching bracket can be positioned at one side of the shelf bracket member with tongues 24 and 25 in registry with the notches 16 and 18 respectively. The protrusions extend from the respective tongues a distance to form a binding fit in the notches but do not extend the full width of the tongues. Thus, the shelf attaching bracket can be merely pressed laterally as shown by the arrow P in FIG. 3, into position on the shelf bracket member. The protrusions press the tongues 24 and 25 into firm engagement with the notch walls 16*a* and 18*a* respectively to distribute the horizontal and vertical forces more uniformly across the notch walls. In addition, the protrusions inhibit lateral movement of the shelf bracket member relative to the shelf attaching member, after they are assembled.

From the foregoing it is thought that the construction and use of the shelf bracket assembly will be readily understood. The shelf bracket member can be formed with various shapes for esthetic purposes and the recesses and notches can be easily formed in the non-metallic bracket member by sawing or rabbeting. The shelf attaching bracket is advantageously formed of a metal strap and can be punched to form the keyhole and formed in a die into the generally L-shaped configuration with the tongues and protrusions on the tongues. When the shelf attaching bracket is assembled onto the shelf bracket member, the depending tongue 24 takes up the horizontal forces which tend to pull the shelf bracket away from the wall and the forwardly extending tongue 25 takes up the vertical component of the forces on the bracket assembly. The protrusions 24*a* and 25*a* on the tongues 24 and 25 maintain the same and firm contact with the notch walls 16*a* and 18*a* respectively to distribute the horizontal and vertical forces more uniformly over these notch walls. Further, the protrusions also function to inhibit lateral movement of the shelf bracket member relative to the shelf attaching bracket after they are assembled.

The embodiments of the invention in which an exclusive property of privilege is claimed are defined as follows:

1. In a shelf bracket adapted for mounting at the rear end thereof on an upright support surface, the shelf bracket including an elongated shelf bracket member having spaced side faces and a top shelf supporting surface and a rear abutment surface extending perpendicular to the top shelf supporting surface adjacent the lower rear portion of the shelf bracket member, the shelf bracket member having a rear recessed surface above and offset forwardly from the rear abutment surface, the shelf bracket member having a first notch extending downwardly from the top shelf supporting surface and spaced forwardly from the rear recessed surface and defining inner and outer opposed notch walls extending between the side faces of the shelf bracket member, the shelf bracket member having a second notch extending forwardly from the rear abutment surface and spaced below the top shelf supporting surface and defining upper and lower opposed notch walls extending between the side faces of the shelf bracket member, a shelf attaching bracket including a rear leg and an upper leg arranged in a generally L-shaped configuration, the rear leg having an upper mounting plate portion spaced rearwardly from said rear recessed surface and a keyhole shaped opening in said upper mounting plate portion for receiving a headed mounting fastener, said upper leg extending forwardly from the upper end of the rear leg in overlying relation to the bracket member and having a first depending tongue at its forward end adapted to extend into said first notch, a second forwardly extending tongue on the lower end of said rear leg adapted to extend into said second notch in the shelf bracket member, said first and second tongues being generally flat and having a thickness less than the spacing between the opposed notch walls of the respective first and second notches, the improvement wherein the first tongue has a protrusion on the side engageable with the outer notch wall of the first notch at a location below the upper leg to press the first tongue against the inner notch wall of the first notch and the second tongue having a protrusion on the side engageable with the lower notch wall at a location forwardly of the rear leg to press the second tongue against the upper notch wall of the second notch whereby to inhibit bending of the first and second tongues relative to the respective upper and rear legs of the shelf bracket attaching member and to inhibit movement of the shelf bracket member laterally of the shelf attaching bracket after assembly thereof.

2. A shelf bracket according to claim 1 wherein said rear recessed surface is stepped and includes a lower rear recessed surface portion offset forwardly from said rear abutment surface a distance substantially equal to the thickness of said rear leg of the shelf attaching bracket and an upper rear recessed surface portion offset forwardly from the lower rear recessed surface portion.

* * * * *